US007824057B2

(12) United States Patent
Shibusawa et al.

(10) Patent No.: US 7,824,057 B2
(45) Date of Patent: Nov. 2, 2010

(54) SHOWCASE

(75) Inventors: Sakumi Shibusawa, Ota (JP); Tetsuya Oketani, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 64 days.

(21) Appl. No.: 12/127,284

(22) Filed: May 27, 2008

(65) Prior Publication Data

US 2008/0304252 A1 Dec. 11, 2008

(30) Foreign Application Priority Data

Jun. 11, 2007 (JP) ..... 2007-154463

(51) Int. Cl.
*A47F 11/00* (2006.01)

(52) U.S. Cl. ..... 362/125; 362/227; 362/133; 362/92; 362/800

(58) Field of Classification Search ..... 362/800, 362/294, 373, 249.02, 219, 227
See application file for complete search history.

(56) References Cited

U.S. PATENT DOCUMENTS 2,846,284 A * 8/1958 Fitzgerald ..... 312/119
5,032,957 A * 7/1991 Canfield ..... 362/133
5,050,047 A * 9/1991 Viner et al. ..... 362/552
6,315,432 B1 * 11/2001 Kuo ..... 362/287
6,619,813 B1 * 9/2003 Schnell ..... 362/116
6,882,111 B2 * 4/2005 Kan et al. ..... 315/122
7,441,922 B2 * 10/2008 Huang et al. ..... 362/235

FOREIGN PATENT DOCUMENTS

| | | |
|---|---|---|
| DE | 43 10 760 A1 | 12/1993 |
| DE | 696 13 806 T2 | 4/2004 |
| EP | 0 242 713 | 10/1987 |
| GB | 2 248 676 A | 4/1992 |
| JP | 5-146346 | 6/1993 |
| WO | WO 2007/043034 A2 | 4/2007 |

OTHER PUBLICATIONS

European Search Report dated Sep. 16, 2008.

* cited by examiner

*Primary Examiner*—Anabel M Ton
(74) *Attorney, Agent, or Firm*—Kratz, Quintos & Hanson, LLP

(57) ABSTRACT

An object is to provide a showcase provided with an illumination device capable of simplifying maintenance operability and effectively illuminating the inside of a display chamber, and the showcase in which the display chamber constituted in a main body is illuminated by the illumination device, the illumination device is constituted of an LED illumination member including LED elements, and a pair of holding members which are attached to a reflective plate on a canopy in the main body to hold the LED illumination member, whereby the irradiation angle of light from the LED illumination member is changeable.

6 Claims, 14 Drawing Sheets

SHOWCASE

BACKGROUND OF THE INVENTION

The present invention relates to a showcase in which a display chamber is constituted in an insulation wall and in which commodities are displayed in the display chamber while cooling the commodities. More particularly, it relates to illumination in a display chamber.

Heretofore, as this type of showcase, there is an open showcase 100 as disclosed in, for example, Japanese Patent Application Laid-Open No. 5-146346 (the patent document) and as shown in FIG. 18. FIG. 18 is a vertical side view showing the conventional open showcase 100. In the open showcase 100, cold air is discharged to a suction port 104 formed in the lower edge of an opening 102 from a discharge port 103 formed in the upper edge of the opening 102 in an insulation wall 101 having a substantially U-shaped section, whereby a cold air curtain is formed in the opening 102. In consequence, the inside of a display chamber 105 surrounded with the insulation wall 101 is cooled at a predetermined temperature. Then, a plurality of fluorescent lamps 108 are attached to a canopy 107 positioned outside the upper edge of the opening 102, the opposite side edges of the opening 102, the lower surfaces of the front parts of shelves 106 and the like, to illuminate the display chamber 105 and the showcase 100 itself.

However, in the conventional open showcase 100, the fluorescent lamps 108 used as illumination devices are obliged to be replaced owing to the lowering of luminance and a lighting defect due to deterioration with an elapse of years. Therefore, a user is forced to perform the replacement operation of the fluorescent lamps 108, which causes a problem that the operation becomes laborious. A new fluorescent lamp 108 for the replacement needs to be stocked, and the storage place of the fluorescent lamp 108 needs to be secured. Furthermore, the fluorescent lamp 108 contains mercury, so that there is a problem that the used fluorescent lamp 108 cannot easily be discarded.

Moreover, to attach the fluorescent lamp 108 in the display chamber 105, components such as a socket and a stabilizer are required, and hence the attachment places of not only the fluorescent lamps but also the sockets, the stabilizers and the like need to be secured in attachment positions. Furthermore, wires have to be connected so as to supply powers to the respective fluorescent lamps, whereby there are problems that assembly operability deteriorates and that the increase of the number of the components and the steep rise of production cost are caused. In addition, the fluorescent lamp has a problem that the lamp flickers owing to the use of an alternate current, and hence eyes are adversely affected.

SUMMARY OF THE INVENTION

The present invention has been developed in order to solve a conventional technical problem, and an object thereof is to provide a showcase including an illumination device capable of simplifying a maintenance operation and effectively illuminating a display chamber.

According to the present invention, there is provided a showcase in which a display chamber constituted in a main body is illuminated by an illumination device, characterized in that the illumination device is constituted of an LED illumination member including LED elements, and a holding member which is attached to the main body to hold the LED illumination member, and the irradiation angle of light from the LED illumination member is changeable.

According to this invention, there is provided the showcase in which the display chamber constituted in the main body is illuminated by the illumination device, wherein the illumination device is constituted of the LED illumination member including the LED elements, and the holding member which is attached to the main body to hold the LED illumination member, and the irradiation angle of the light from the LED illumination member can be changed, whereby the irradiation light rectilinearly coming in parallel from the LED elements can be directed in an arbitrary direction. Therefore, the angle can be changed toward a necessary irradiation position in accordance with a position where the illumination device is attached.

In consequence, even when the illumination devices are attached to the canopy of the main body, shelves and the like, a satisfactory illumination effect can be realized.

Moreover, the LED illumination device does not radiate any harmful ultraviolet ray or heat ray to commodities displayed in the display chamber, so that the commodities can be illuminated without being heated as compared with conventional fluorescent lamps.

Furthermore, the showcase of the present invention is characterized in that in the above invention, the LED illumination member is rotated around the axis of the LED illumination member in a longitudinal direction with respect to the holding member, whereby the irradiation angle of the light from the LED illumination member is changeable.

According to this invention, in the above invention, the LED illumination member is rotated around the axis of the LED illumination member in the longitudinal direction with respect to the holding member, whereby the irradiation angle of the light from the LED illumination member can be changed. Therefore, the irradiation angle from the LED Illumination member can easily be changed.

Moreover, the showcase of the present invention is characterized in that in the above invention, a pair of holding members corresponding to the opposite ends of the LED illumination member in the longitudinal direction are provided, the LED illumination member includes attachment portions which are provided on the opposite ends of the LED illumination member in the longitudinal direction and which are inserted into and held in the holding member, and an engaging portion formed on one of the attachment portion and the holding member is selectively engaged with one of a plurality of portions to be engaged formed on the other one of the attachment portion and the holding member, whereby the irradiation angle of the light from the LED illumination member is changeable.

According to this invention, in the above invention, the pair of holding members corresponding to the opposite ends of the LED illumination member in the longitudinal direction are provided, the LED illumination member includes the attachment portions which are provided on the opposite ends of the LED illumination member in the longitudinal direction and which are inserted into and held in the holding members, and the engaging portion formed on one of the attachment portion and the holding member is selectively engaged with one of the plurality of portions to be engaged formed on the other one of the attachment portion and the holding member, whereby the irradiation angle of the light from the LED illumination member can be changed. Therefore, the irradiation angle of the light emitted by the LED illumination member can stably be held. In consequence, appropriate commodity illumination can be maintained.

Moreover, the showcase of the present invention is characterized in that in the above inventions, the LED illumination member includes a substrate provided with the LED elements, a heat release member, and a reflective plate which is engaged with and attached to the heat release member and which has at least one reflective surface, and the reflective plate presses the substrate onto the heat release member in a state in which the LED elements are opposed to the side of the reflective surface.

According to this invention, in the above inventions, the LED illumination member includes the substrate provided with the LED elements, the heat release member, and the reflective plate which is engaged with and attached to the heat release member and which has at least one reflective surface, and the reflective plate presses the substrate onto the heat release member in the state in which the LED elements are opposed to the side of the reflective surface. In consequence, it is possible to easily hold the substrate provided with the LED elements without using any fixing member such as a screw, and the number of components can be reduced.

Furthermore, the heat release member is pressed onto and attached to the substrate, so that heat generated from the substrate can efficiently be released, and smooth illumination can be realized.

In addition, according to the showcase of the present invention, in the above invention, the outer surface of the heat release member has a circular shape around the axis of the LED illumination member in the longitudinal direction.

According to this invention, in the above invention, the outer surface of the heat release member has the circular shape around the axis of the LED illumination member in the longitudinal direction, whereby the angle adjustment performed by the rotation of the LED illumination member can be carried out without any trouble.

Moreover, the showcase of the present invention is characterized in that in the above inventions, the holding member includes an attachment leg portion which is engageable with an attachment hole in a socket for a fluorescent lamp formed in the main body.

According to this invention, in the above inventions, the holding member includes the attachment leg portion which is engageable with the attachment hole in the socket for the fluorescent lamp formed in the main body, so that even in the existing showcase in which a display chamber is illuminated with the fluorescent lamp, the holding member can be attached using the attachment hole of the socket for the fluorescent lamp used in attaching the fluorescent lamp, and versatility can be enlarged.

DETAILED DESCRIPTION OF THE PREFERRED EMBODIMENT

Figure 1:
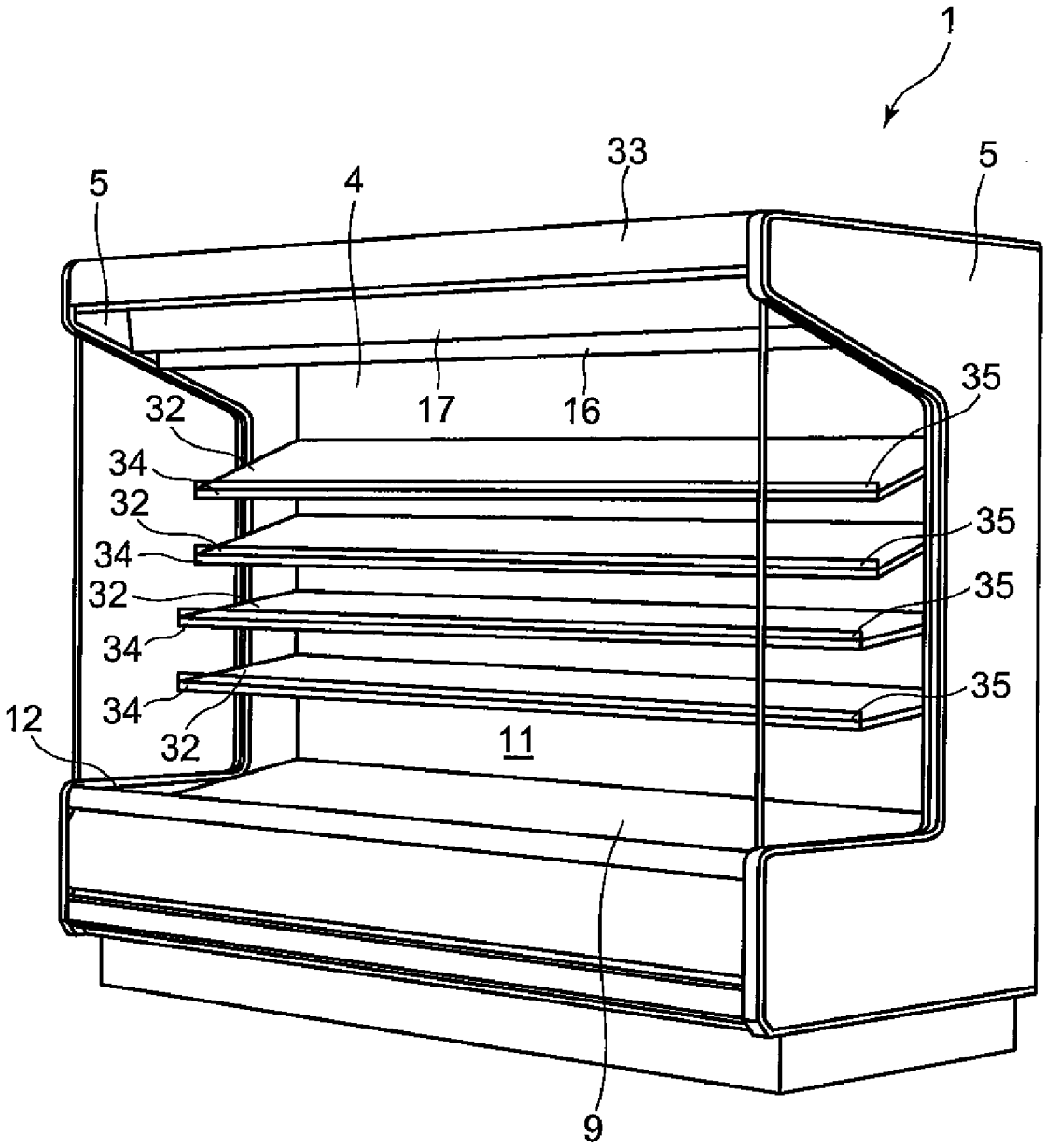
FIG. 1 is a perspective view showing an open showcase to which the present invention is applied.
Figure 2:
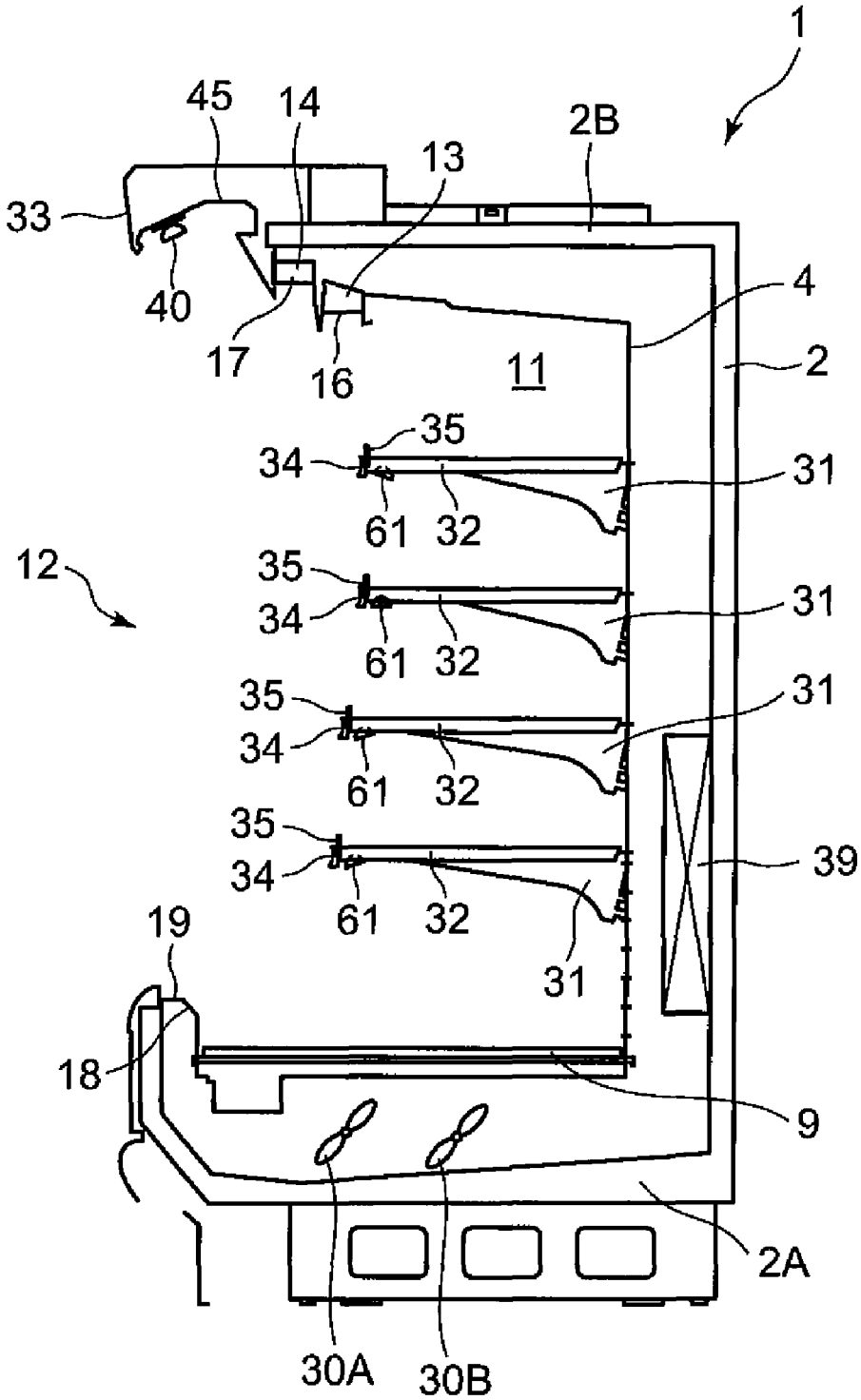
FIG. 2 is a vertical side view showing the open showcase of FIG. 1.

Next, embodiments of the present invention will be described in detail with reference to the drawings. FIG. 1 is a perspective view showing an open showcase 1 to which the present invention is applied, and FIG. 2 is a vertical side view showing the open showcase 1 of FIG. 1, respectively. The open showcase 1 is a vertical type open showcase installed in a store such as a supermarket, and the showcase is constituted of an insulation wall (a main body) 2 having a front surface opened and substantially having a U-shaped section, and insulation side plates 5, 5 attached to the side surfaces of the insulation wall 2.

On the inner side of the insulation wall 2 of the open showcase 1, a partition plate 4 and another partition plate (not shown) are attached with spaces from the wall, respectively, and a duct including two inner and outer layers (not shown) is formed between the partition plate 4 and the like and the insulation wall 2. A bottom plate 9 is attached to the front portion of the lower end of the inner partition plate 4 with a space for a duct provided between the bottom plate and a bottom wall 2A of the insulation wall 2, and a display chamber 11 is disposed on the inner side of the partition plate 4 and the bottom plate 9.

Moreover, in the display chamber 11, there are extended a plurality of stages each including a pair of brackets 31 having a height and an attachment angle which can be changed and attached to a support (not shown) in the back part of the display chamber 11, and a shelf plate 32 constituting a shelf together with these brackets. Price rails 34 formed of a hard synthetic resin are attached to the front edges of the shelf plates 32, and the price rails 34 also serve as decorative members for the shelf plates 32. Furthermore, a predetermined space is formed between the front walls of the shelf plates 32 and the price rails 34, and guards 35 for preventing commodities from dropping down from the shelf plates 32 are attached in the space.

On the upper edge of a front opening 12 in the insulation wall 2, an inner discharge port 16 and an outer discharge port 17 provided with honeycomb members 13, 14, respectively, are arranged. The inner discharge port 16 and the outer discharge port 17 communicate with an inner duct and an outer duct, respectively. Moreover, an inner suction port 18 and an outer suction port 19 are arranged in the lower edge of the opening 12.

On the other hand, blowers 30A, 30B corresponding to the inner duct and the outer duct, respectively, are installed on the bottom wall 2A of the insulation wall 2 in a rear part under the bottom plate 9.

A cooler 39 for a cooling device is vertically provided in the inner duct behind the back partition plate 4. In a case where the blower corresponding to the inner duct is operated, cold air which has performed heat exchange between the air and the cooler is raised through the inner duct, and discharged from the inner discharge port 16 to the inner suction port 18. Then, the cold air sucked from the inner suction port 18 is accelerated by the blower.

On the other hand, when the blower corresponding to the outer duct is operated, the air in the outer duct is raised through the outer duct, and discharged from the outer discharge port 17 to the outer suction port 19. Then, the cold air sucked from the outer suction port 19 is accelerated by the blower. In consequence, double front and rear air curtains are formed in the opening 12, and a part of the inner cold air curtain is circulated through the display chamber 11 to cool the display chamber 11.

Figure 3:
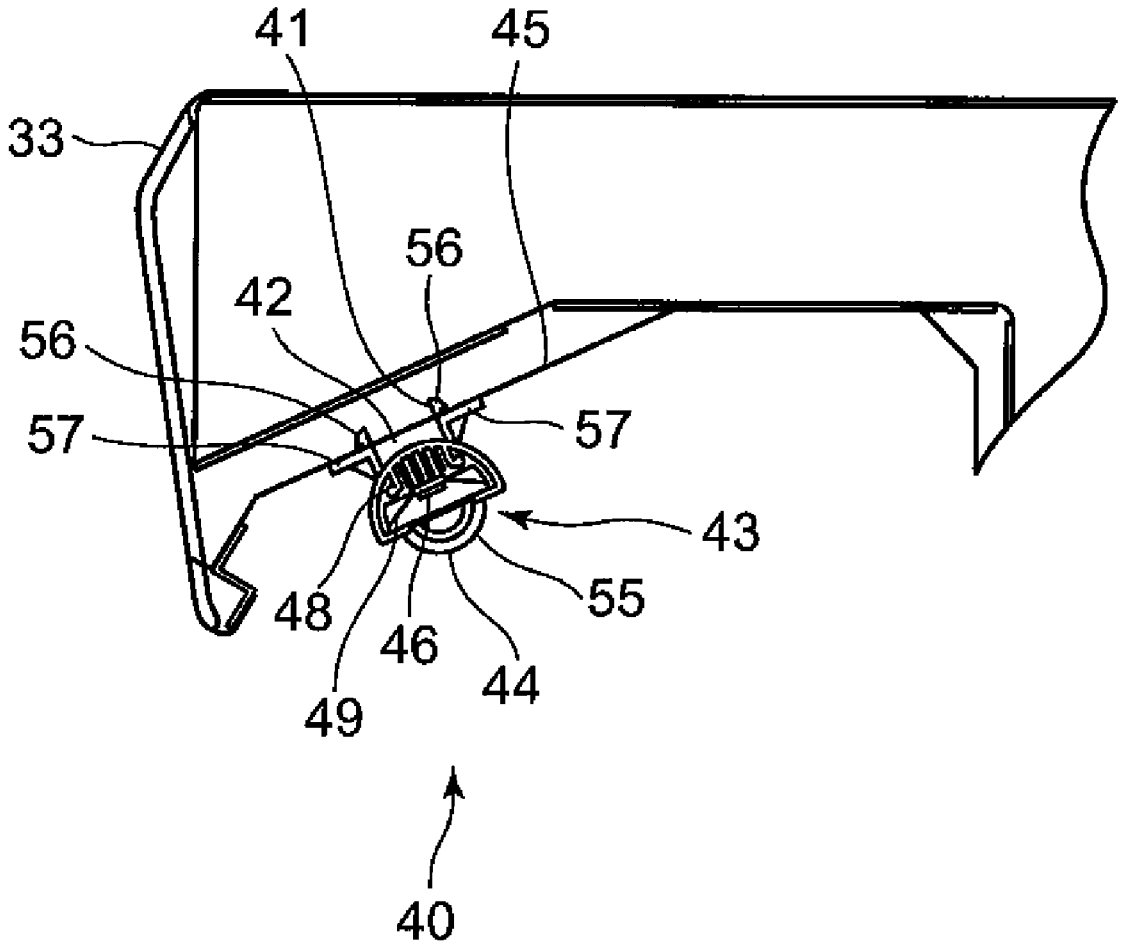
FIG. 3 is a partially enlarged sectional view of FIG. 2.

Next, the constitution of the front part of a ceiling wall 2B of the insulation wall 2 will be described with reference to the partially enlarged sectional view of the showcase 1 in FIG. 3. A canopy 33 which protrudes forwards is attached to the front end (the upper part front end) of the ceiling wall 2B of the insulation wall 2. On the inner side of this canopy 33, a reflective plate 45 is attached so as to extend externally from the front opening 12 of the display chamber 11.

This reflective plate 45 is constituted of a decorated metal plate, and the front portion of the reflective plate 45 in the present embodiment is constituted at an angle opposed to the front opening 12 of the display chamber 11 from an upper front part, that is, so as to face the display chamber 11 which is disposed obliquely rearwards under the reflective plate. Then, illumination attachment holes 41 for detachably attaching a holding member 42 of an LED illumination device 40 are formed in the left and right side portions of the front part. It is to be noted that in the present embodiment, the LED illumination device 40 is attached so as to extend in a longitudinal direction from one side portion to the other side portion of the front opening 12 of the display chamber 11, so that the illumination attachment holes 41 are formed in the left and right side portions, respectively, but the present invention is not limited to this example. In a case where a plurality of LED illumination devices 40 are arranged in series over the longitudinal direction of the front opening 12, the illumination attachment holes 41 may be formed in positions corresponding to the side portions of the respective LED illumination devices 40.

Figure 4:
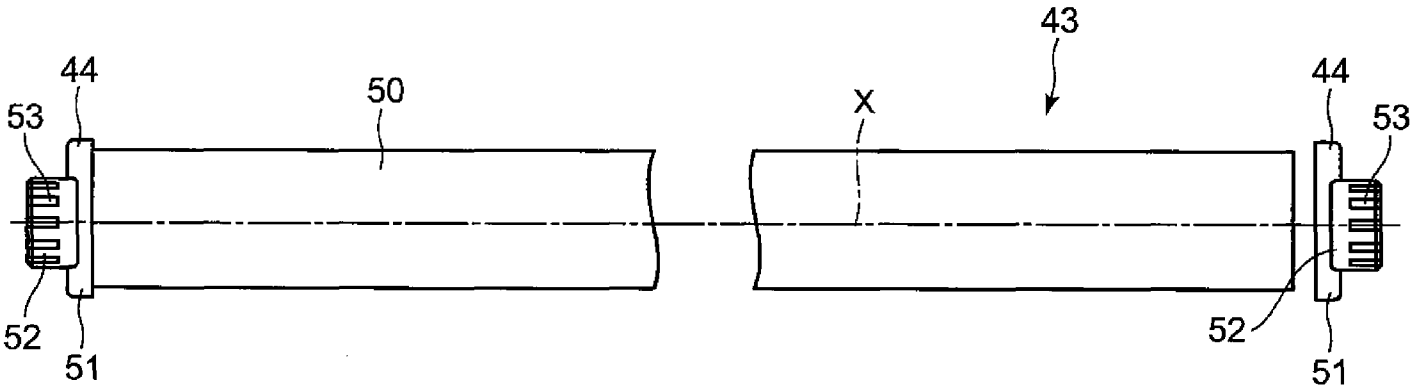
FIG. 4 is a plan view showing an LED illumination member.
Figure 5:
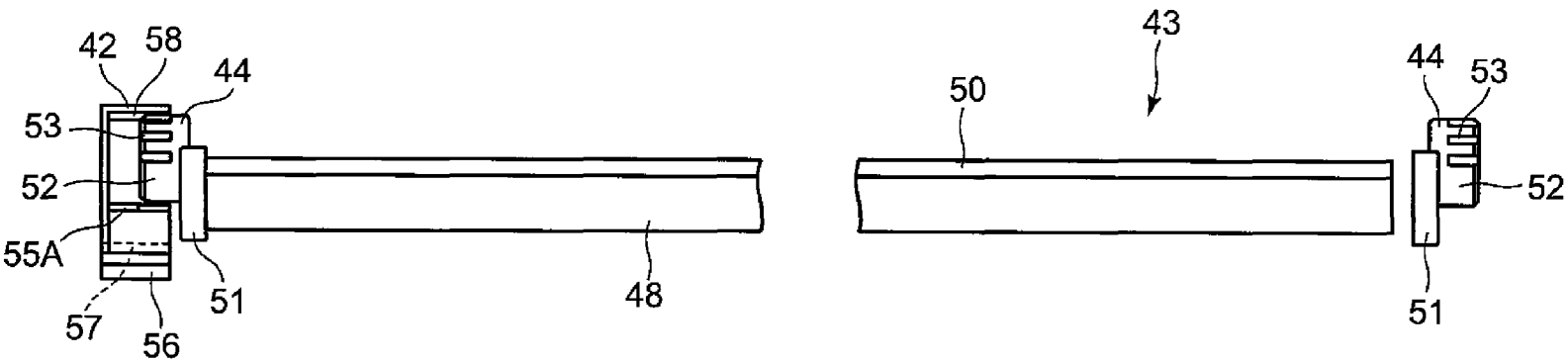
FIG. 5 is a partially sectional view showing a state in which one side portion of the LED illumination member is attached to the holding member.
Figure 6:
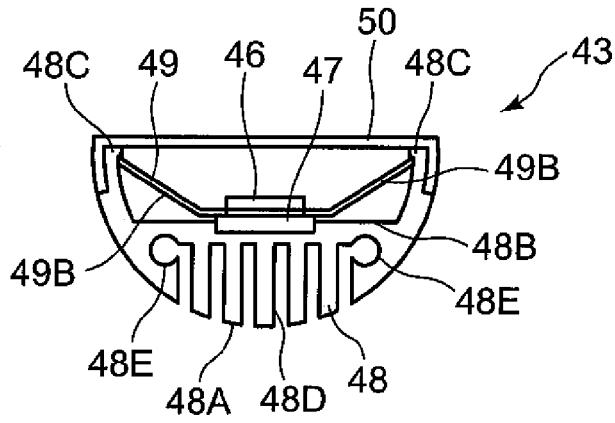
FIG. 6 is a vertically sectional view showing the LED illumination member.
Figure 7:
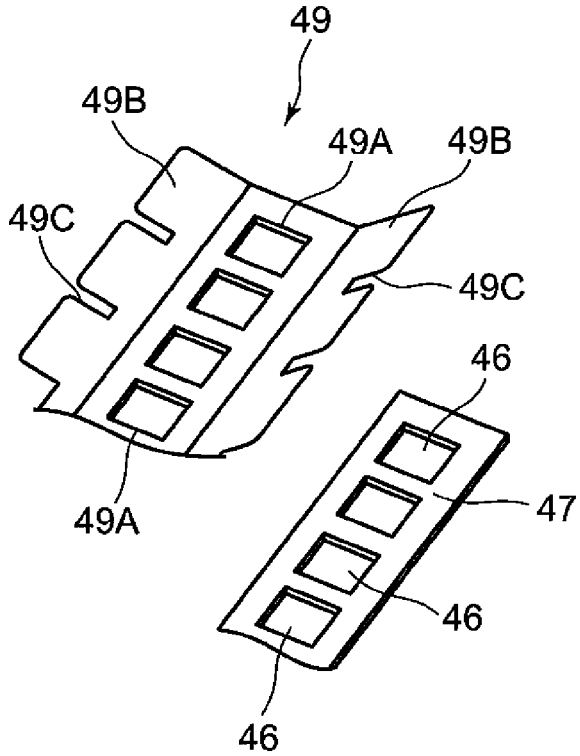
FIG. 7 is an exploded perspective view showing a reflective plate and LED elements in the LED illumination member.
Figure 9:
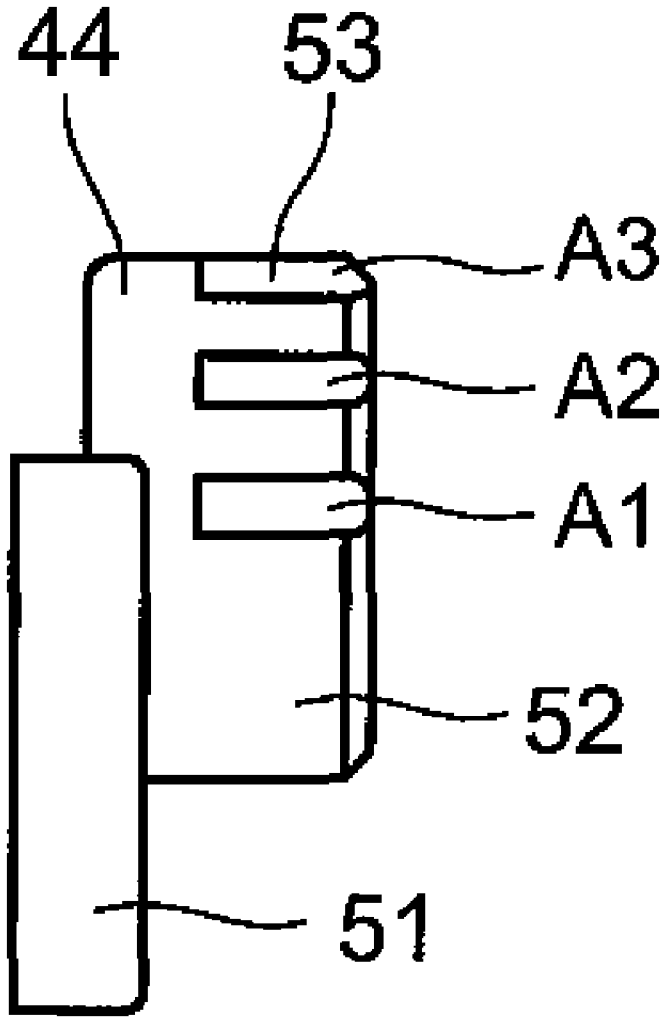
FIG. 9 is a front view similarly showing the attachment portion.
Figure 10:
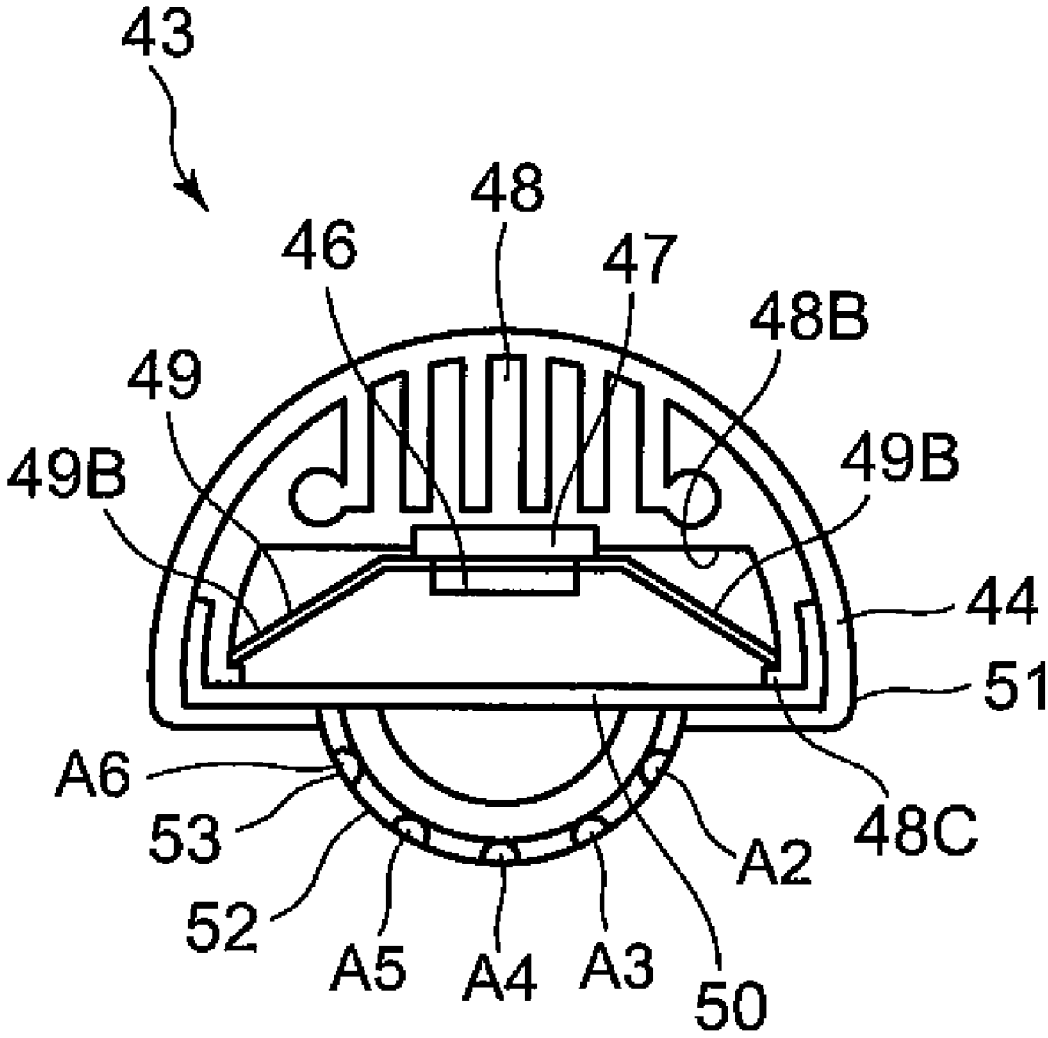
FIG. 10 is a vertically sectional view showing the LED illumination member.
Figure 11:
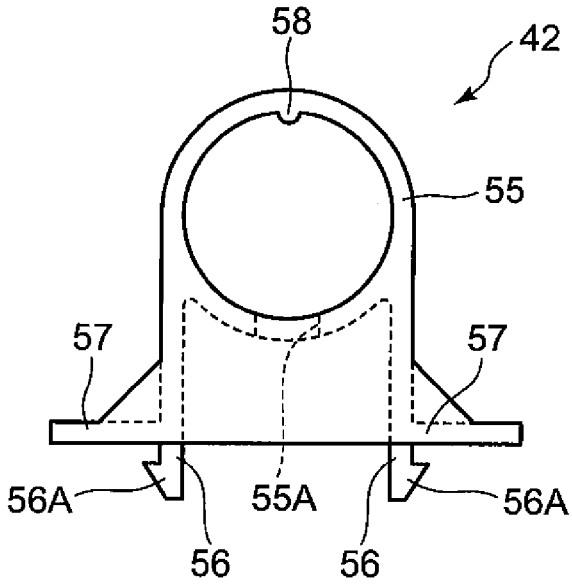
FIG. 11 is a partially perspective side view showing the holding member.
Figure 12:
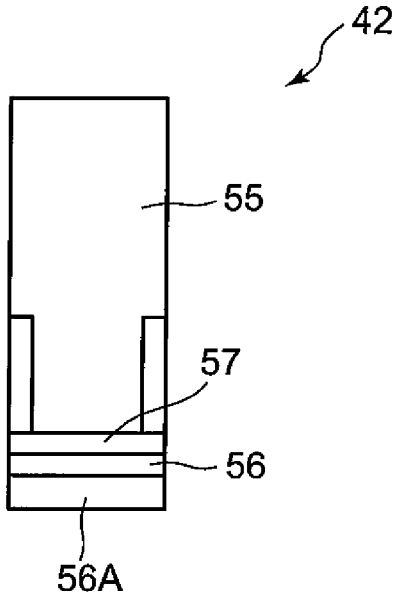
FIG. 12 is a front view showing the holding member.
Figure 13:
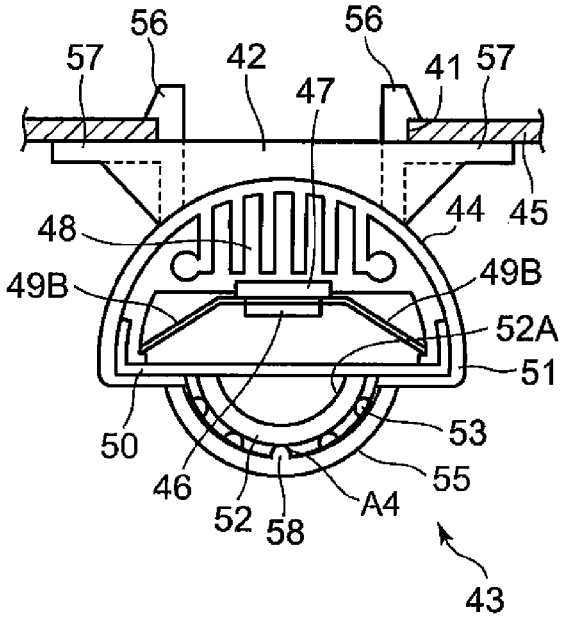
FIG. 13 is a vertically sectional view showing the LED illumination member held by the holding member.
Figure 14:
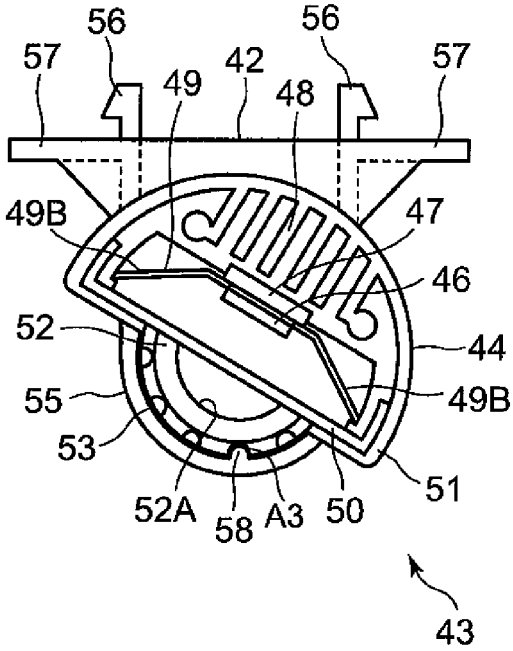
FIG. 14 is a vertically sectional view showing the LED illumination member held by the holding member.
Figure 15:
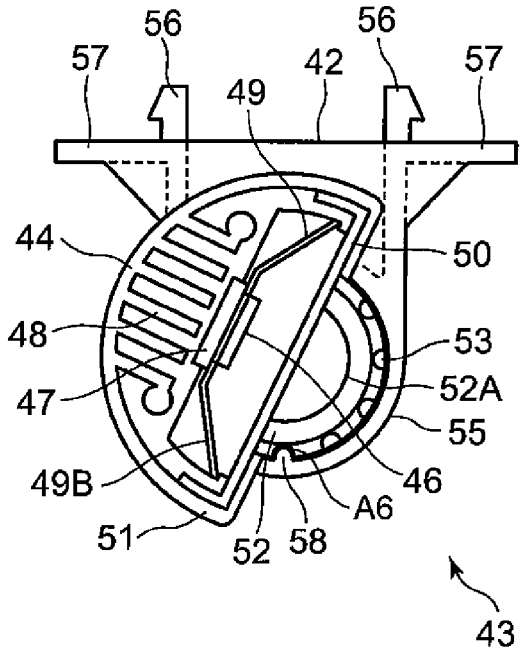
FIG. 15 is a vertically sectional view showing the LED illumination member held by the holding member.
Figure 8:
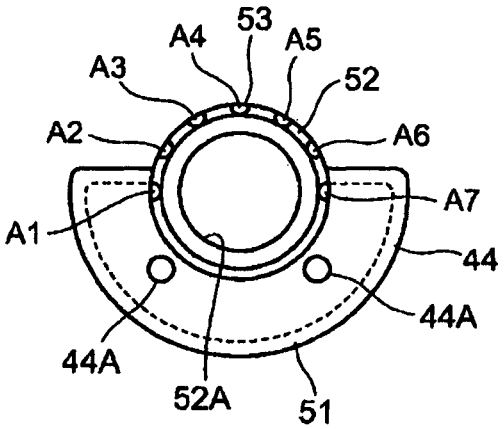
FIG. 8 is a side view showing an attachment portion in the LED illumination member.
Figure 9:
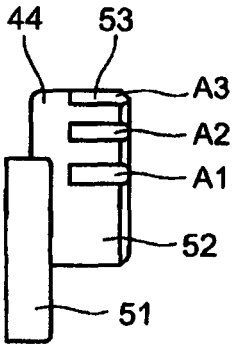

In the present embodiment, the LED illumination device 40 is constituted of an LED illumination member 43, and the holding member 42 which detachably holds the LED illumination member 43. The LED illumination device 40 according to the present invention will hereinafter be described in detail with reference to FIGS. 4 to 15. FIG. 4 is a plan view showing the LED illumination member 43, FIG. 5 is a partially sectional view showing a state in which one side portion of the LED illumination member 43 is attached to the holding member 42, FIG. 6 is a vertically sectional view showing the LED illumination member 43, FIG. 7 is an exploded perspective view showing a reflective plate and LED elements in the LED illumination member 43, FIG. 8 is a side view showing an attachment portion 44 in the LED illumination member 43, FIG. 9 is a front view similarly showing the attachment portion 44, FIG. 10 is a vertically sectional view showing the LED illumination member 43, FIG. 11 is a partially perspective side view showing the holding member 42, FIG. 12 is a front view showing the holding member 42, and FIGS. 13 to 15 are vertically sectional views showing the LED illumination member 43 held by the holding member 42, respectively.

The LED illumination member 43 is constituted of a substrate 47 provided with a plurality of LED elements 46, a heat release member 48, a reflective plate 49 and the attachment portion 44. The substrate 47 is constituted so as to extend in the longitudinal direction, and the plurality of LED elements 46 are attached to the substrate 47 at predetermined intervals as shown in FIG. 7. The LED elements 46 of the present embodiment are chip type white LED elements. In the present embodiment, the front opening 12 of the open showcase 1 is formed to extend as much as six shaku (about 1830 mm), so that about 108 LED elements 46 are used.

The heat release member 48 is a thermally conductive member formed to extend in the longitudinal direction of the front opening 12 in the same manner as in the substrate 47. An outer surface 48A has a circular shape around the longitudinal axis (a rotation axis X described later) of the LED illumination member 43, and is provided with a plurality of slits 48D directed internally from the outer surface.

Then, in the end face of the heat release member 48 on a side on which a chord is constituted with respect to this circular outer surface 48A, a substrate receiving portion 48B is recessed inwards and formed over the longitudinal direction. Engagement claws 48C, 48C slightly protruded toward the rotation axis X are formed in upper end edges positioned substantially in parallel with the rotation axis X of this substrate receiving portion 48B. Moreover, on the end face of the heat release member on the side on which the chord is constituted with respect to the circular heat release member 48, a shade 50 constituted of a light-blocking colorless transparent material for covering the outer surface of the substrate receiving portion 48B is detachably attached.

Then, the substrate receiving portion 48B of the heat release member 48 receives the reflective plate 49 provided with the substrate 47. The reflective plate 49 is a plate-like member formed over the longitudinal direction in the same manner as in the substrate 47, and the plate is provided with a plurality of LED element holes 49A . . . over the longitudinal direction. Then, the opposite ends of the reflective plate 49 provided with the LED element holes 49A in the longitudinal direction are reflective surfaces 49B bent at a predetermined angle toward a light irradiation side shown in FIG. 7, that is, toward the display chamber 11 in the present embodiment. The reflective surfaces 49B are provided with a plurality of notches 49C directed externally at predetermined intervals.

According to such a constitution, the substrate 47 provided with the LED elements 46 is attached to the surface of the reflective plate 49 opposite to the light irradiation side of the reflective plate, and the LED elements 46 are opposed to the side of the reflective surfaces 49B (the light irradiation side) via the LED element holes 49A formed in the reflective plate 49. The reflective plate 49 having this state is received in the substrate receiving portion 483 of the heat release member 48, and both the ends of the substrate receiving portion 48B of the reflective plate 49 are engaged with the engagement claws 48C formed on the upper edge of the substrate receiving portion 48B. At this time, both the ends of the reflective plate 49 are bent at a predetermined angle with respect to the surface provided with the LED element holes 49A, whereby the reflective surfaces 49B engage with the engagement claws 48C to press, onto the circular heat release member 48, the surface of the reflective plate provided with the LED element holes 49A, that is, the surface of the reflective plate provided with the substrate 47. It is to be noted that the reflective surfaces 49B are provided with a plurality of notches 49C as described above, and hence can easily be engaged with the engagement claws 48C.

In consequence, the substrate 47 provided with the LED elements 46 can easily be held by the heat release member 48 without using any fixing member such as a screw, and the number of compositions can be reduced. Then, the substrate 47 pressed onto the heat release member 48 is attached, whereby the heat of the substrate 47 generated by light emitted from the LED elements 46 can efficiently be transmitted to the heat release member 48, and released, and smooth illumination can be realized.

Then, the attachment portions 44 are fixed by screws 44A, 44A to both the ends of the heat release member 48 provided with the substrate 47 in the longitudinal direction as described above. It is to be noted that reference numerals 48E, 48E in FIG. 6 are screw holes for attaching the attachment portion 44 to the heat release member 48 with the screws 44A. This attachment portion 44 is constituted of a main body 51 having a semicircular outer shape so as to close either end of the heat release member 48, and an attachment portion 52 provided on the outer surface of the main body 51 (on a side opposite to the side provided with the LED illumination member 43, that is, the side of the holding member 42 described later).

In the present embodiment, the attachment portion 52 substantially has a circular section, and the center of the circle is substantially the same as that forming the heat release member 48. It is also constituted that the rotation axis of the attachment portion 52 is substantially similar to the axis X. Then, the outer surface of the attachment portion 52 is provided with engagement grooves 53 at each predetermined angle of, for example, 30° with respect to the axis X It is to be noted that in the present embodiment, as shown in FIG. 8, seven engagement grooves 53 A1 to A7 are formed, and these grooves are positioned on the light irradiation side of the LED elements 46 of the LED illumination member 43. It is to be noted that these engagement grooves 53 constitute a portion to be engaged for detachably engaging with an engaging portion 58 of the holding member 42 described later.

Moreover, this attachment portion 52 is provided with a wire drawing hole 52A which connects the substrate receiving portion 48B of the heat release member 48 to the outside. Therefore, the wire of the substrate 47 received in the substrate receiving portion 48B is drawn outwards via the wire drawing hole 52A, and the wire is connected to the inside of the main body 2.

Next, the constitution of the holding member 42 will be described. A pair of holding members 42 corresponding to both the ends of the LED illumination member 43 in the longitudinal direction are provided, and are members for attaching the LED illumination member 43 to be provided on the main body 2 of the open showcase 1, that is, the reflective plate 45 in the canopy 33. Each of the holding members 42 in the present embodiment has a holding portion 55 which opens on the side of the LED illumination member 43 to be attached, attachment leg portions 56 provided with engagement claws 56A to be attached to the illumination attachment holes 41 formed in the reflective plate 45 of the canopy 33, and press plates 57.

The holding portion 55 has a bottomed cylindrical shape which opens on the side of the LED illumination member 43, and the inner wall surface of the holding portion is provided with the engaging portion 58 which protrudes inwards and which detachably engages with one of the engagement grooves 53 of the attachment portion 44. It is to be noted that in the present embodiment, the engaging portion 58 is formed in such a position as to face an attachment side with respect to the insulation wall 2 side of the holding member 42, specifically in a position on the light irradiation side of the LED illumination member 43. Moreover, the inner side surface of the holding portion 55 is provided with a wire drawing hole 55A which extends through the surface. It is to be noted that the holding portion 55 for use in the present embodiment is constituted of a material having a certain degree of flexibility.

It is to be noted that in the conventional open showcase, instead of the LED illumination device of the present invention, fluorescent lamps and the like are attached. In this case, sockets for detachably attaching the fluorescent lamps to the main body 2 are provided, and attachment holes for use as holes for attaching the sockets may be used as the illumination attachment holes 41 of the present invention.

A method for attaching the LED illumination device 40 of the present invention having such a constitution will be described. First, the engagement claws 56A of the attachment leg portions 56 formed in the pair of holding members 42 as described above are inserted into and engaged with the illumination attachment holes 41 formed in the reflective plate 45 of the canopy 33. Afterward, in a state in which the LED illumination member 43 including the LED elements 46, the attachment portions 44 and the like as described above are directed into the display chamber 11 so that the light irradiation angle of the LED elements 46 is an arbitrary angle, the attachment portions 52 of the attachment portions 44 are inserted into the holding portions 55 of the holding members 42 provided corresponding to both the ends of the LED illumination member 43 in the longitudinal direction. Then, one of the engagement grooves 53 formed in the attachment portion 52 is detachably engaged with the engaging portion 58 formed in the holding portion 55 by use of the flexibility of the holding member 42.

In consequence, the LED illumination member 43 can be fixed to the reflective plate 45 of the canopy 33 in a state in which the LED illumination member is held at an arbitrary angle. Moreover, in the present embodiment, when the light irradiation angle of the LED illumination device 40 is changed, the LED illumination member 43 is once removed from the holding members 42, and the LED illumination member 43 is rotated around the rotation axis X of the member in the longitudinal direction, whereby the engagement groove 53 to be engaged with the engaging portion 58 of the holding portion 55 is selected, and the selected engagement groove 53 is engaged with the engaging portion 58. In consequence, the irradiation angle of the light from the LED illumination member 43 can be changed. According to the constitution, the irradiation angle of the light from the LED illumination member 43 can stably be held, and appropriate commodity illumination can be maintained.

It is to be noted that FIG. 13 shows a state in which as the engagement groove 53 to be engaged with the engaging portion 58 of the holding portion 55, the engagement groove A4 is used. In this case, the irradiation light from the LED elements 46 can be directed into the display chamber 11 from an angle substantially parallel to the surface of the reflective plate 45 to which the LED illumination member 43 is attached, to irradiate the display chamber. FIG. 14 shows a state in which as the engagement groove 53 to be engaged with the engaging portion 58 of the holding portion 55, the engagement groove A3 is used. In this case, the light from the LED elements 46 can be directed so as to comparatively irradiate the front part of the display chamber 11 and a part in front of the chamber. FIG. 15 shows a state in which as the engagement groove 53 to be engaged with the engaging portion 58 of the holding portion 55, the engagement groove A6 is used. In this case, the light from the LED elements 46 can be directed so as to comparatively irradiate the inner part of the display chamber 11.

In this case, as described above, the outer surface 48A of the heat release member 48 constituting the LED illumination member 43 has a circular section around the rotation axis X, so that it is possible to avoid a disadvantage due to the interference of the heat release member 48 with a peripheral device, depending on the attachment position of the heat release member.

In consequence, the irradiation light substantially rectilinearly coming in parallel from the LED elements 46 of the LED illumination member 43 can be directed in an arbitrary direction, and the irradiation light can be supplied to the commodities displayed in the display chamber 11. Moreover, the irradiation light can be supplied to the necessary irradiation position in accordance with the position of the canopy 33 where the LED illumination member is attached. Therefore, an illumination effect can be improved.

Figure 19:
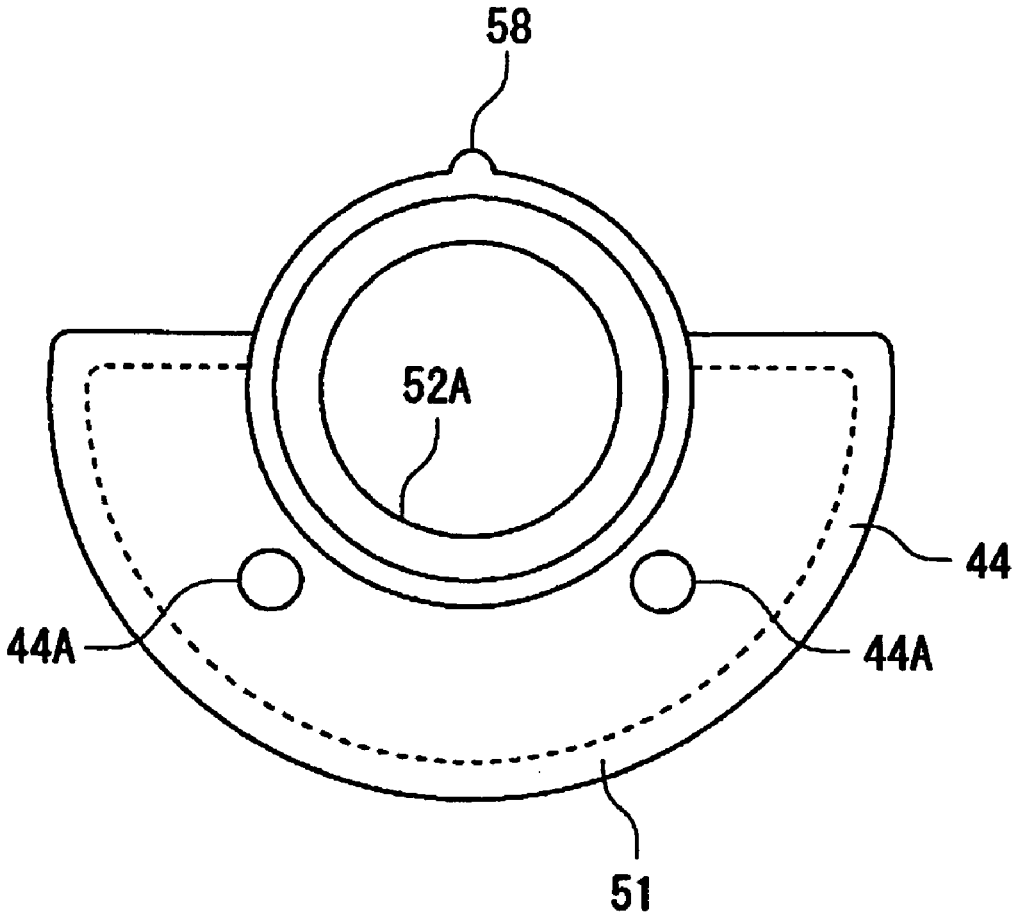
FIG. 19 is a side view of a second embodiment showing an attachment portion in the LED illumination member.
Figure 20:
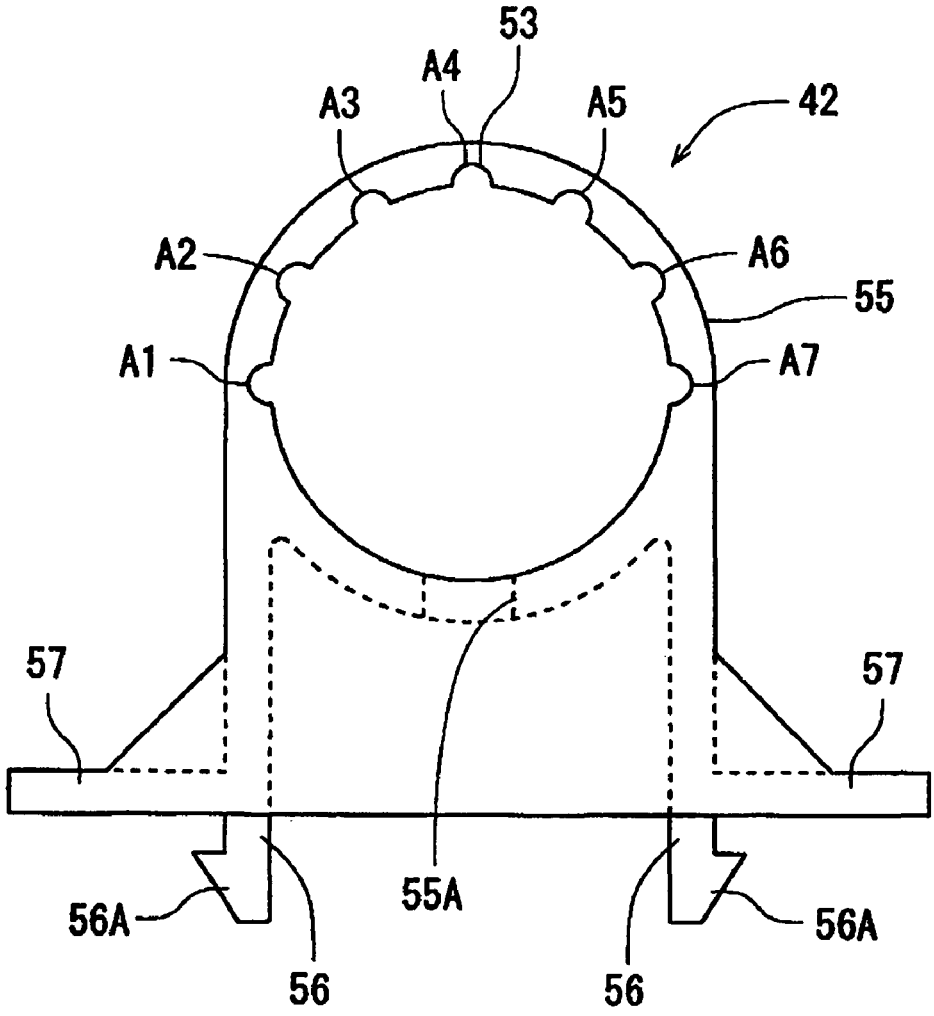
FIG. 20 is a partially perspective side view of the second embodiment showing the holding member.

It is to be noted that in the present embodiment, a plurality of portions to be engaged are formed on the side of the attachment portion 44 constituting the LED illumination member 43, and the engaging portion 58 is formed on the side of the holding member 42, but the present invention is not limited to this example. In a second embodiment, the engaging portions may be formed on the side of the attachment portion 44 constituting the LED illumination member 43, and the portions to be engaged such as the engagement grooves may be formed on the side of the holding member 42, as shown in FIGS. 19 and 20. The number of the portions to be engaged and the number of the engaging portions are not limited to those of this example. Even in this case, a similar effect can be produced.

Furthermore, in the present embodiment, when the irradiation angle of the LED illumination member 43 is changed, as described above, the member is once removed, and one of the engagement grooves 53 is selectively engaged with the engaging portion 58 of the holding member 42 to realize the change, but the present invention is not limited to this example. In a case where the holding portion 55 of the holding member 42 and the attachment portion 52 of the attachment portion 44 have predetermined flexibility, the attachment portion 52 is rotated around the rotation axis X in a state in which the attachment portion 44 is attached to the holding member 42 as it is, whereby the angle of the irradiation light from the LED illumination member 43 can be changed.

In consequence, the irradiation angle of the LED illumination member 43 can easily be changed, and hence convenience can be improved.

Figure 16:
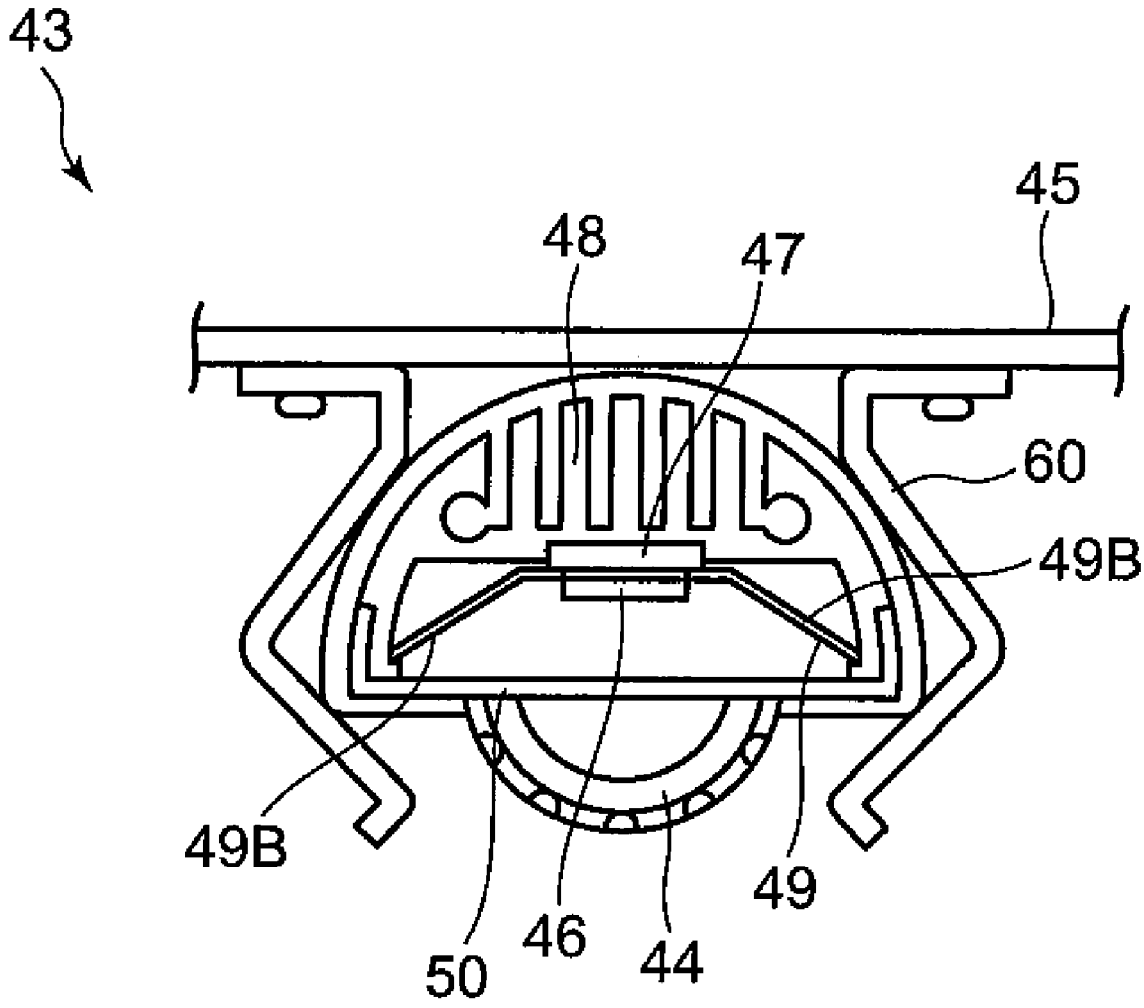
FIG. 16 is a vertically sectional view showing an LED illumination member as another embodiment.

Moreover, in the present embodiment, as means for attaching the LED illumination member 43 to the reflective plate 45 of the canopy 33 on the main body 2 side, the holding member 42 fixed to the main body 2 side is used, but additionally, as shown in FIG. 16, a clip substantially having a C-shaped section may be used which has been used in holding a fluorescent lamp having a circular section in the existing showcase or the like. In consequence, the holding member 42 specially provided with the engaging portion 58 does not have to be used, and the LED illumination member 43 according to the present invention can be held using a fluorescent lamp holding clip 60 used in the existing showcase. Moreover, the LED illumination member 43 held by the clip 60 is rotated around the rotation axis X with respect to the clip 60, whereby the irradiation angle can be changed without any trouble. Therefore, versatility can be enlarged, and appropriate illumination can be realized by the illumination device 40 even in the existing showcase.

Furthermore, even in this case, the outer surface 48A of the heat release member 48 constituting the LED illumination member 43 has a circular shape, so that the member can firmly be held by the clip 60.

It is to be noted that in this case, the LED illumination member 43 is attached by the clip 60 in a state in which the LED illumination member 43 abuts on the surface (here the reflective plate 45) to which the LED illumination member is to be attached. In consequence, the heat generated by the substrate 47 of the LED illumination member 43 can be released by not only the heat release member 48 but also the abutting reflective plate 45, and hence heat release efficiency can be improved. It is to be noted that a structure in which the heat release member 48 is allowed to abut on the reflective plate 45 is not limited to the holding by the clip 60, and the structure may be employed in a case where the illumination member is held using the attachment portion 44 as described above, whereby the improvement of the heat release efficiency is realized.

Figure 17:
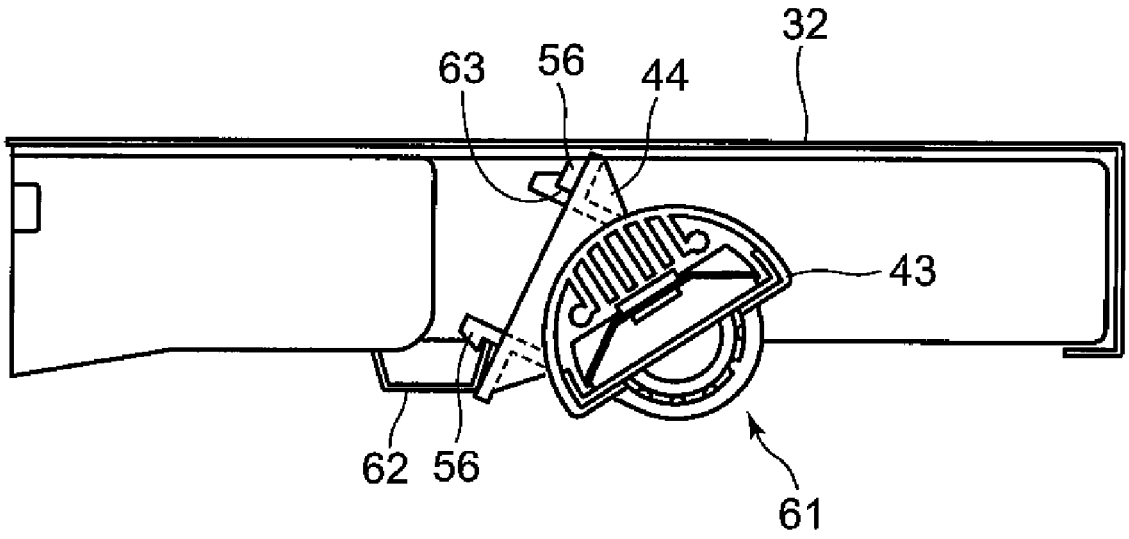
FIG. 17 is a vertically sectional view showing an LED illumination device provided on the lower surface of a shelf plate.
Figure 18:
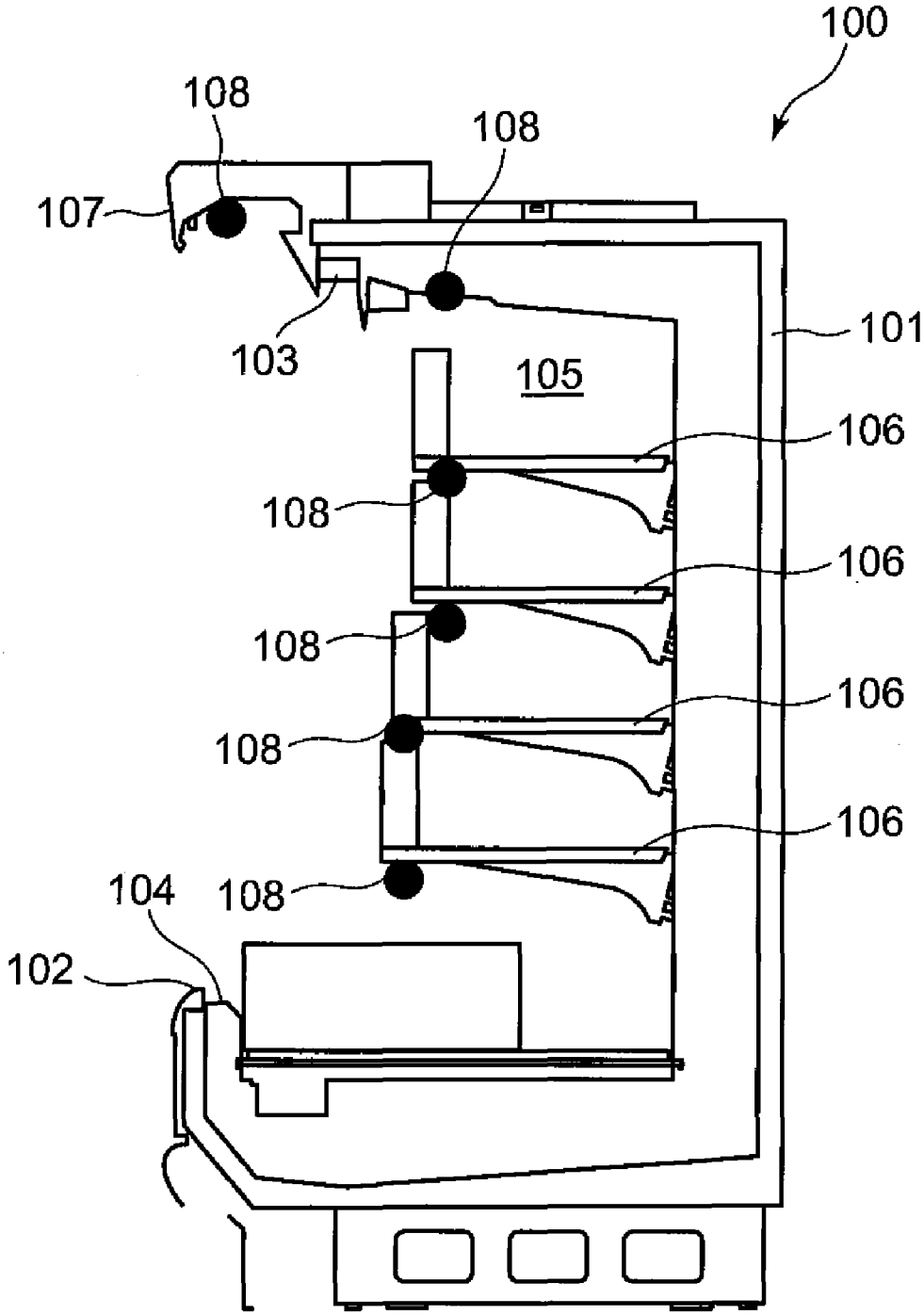
FIG. 18 is a vertical side view of a conventional open showcase.

Moreover, as shown in FIG. 17, an LED illumination device 61 substantially constituted in the same manner as in the LED illumination device 40 may be attached to the front part of the lower surface of the shelf plate 32 in the display chamber 11 over the longitudinal direction. In such a case, a reinforcement member 62 constituted so as to extend horizontally along the front part of the shelf plate 32 is provided with an engagement hole 63 for attaching the attachment portion 44, and the attachment leg portions 56 of the attachment portion 44 are inserted into the engagement hole 63 to engage with the engagement hole, whereby the attachment portions 44 hold the opposite ends of the LED illumination member 43 in the longitudinal direction in the same manner as in the LED illumination device 40.

In consequence, even in a case where the illumination device is provided on the lower part of the shelf plate 32, in the same manner as in a case where the illumination device is provided on the reflective plate 45 of the canopy 33, the illumination device can be attached so that the irradiation angle can arbitrarily be adjusted, whereby a satisfactory illumination effect can be realized.

It is to be noted that the attachment positions of the LED illumination devices 40, 61 described above are not limited to the reflective plate 45 of the canopy 33 and the front part of the lower surface of the shelf plate 32. In addition, even when the illumination device is provided on a hand rail or the like forming the lower edge of the front opening 12, a similar effect can be produced, and a presentation effect produced by illumination can be improved.

Moreover, in the above-mentioned LED illumination devices 40, 61, any harmful ultraviolet ray or heat ray is not radiated to the commodities displayed in the display chamber 11, so that the commodities can be illuminated without heating them as compared with the conventional fluorescent lamps or the like. Furthermore, unlike the heretofore used fluorescent lamps, any flicker is not generated in the illumination of the LED elements 46, so that stable illumination can be performed, and the appropriate illumination of the commodities can be realized. Furthermore, with regard to the illumination of the LED elements 46, dimmer control can easily be changed. Therefore, the dimmer control is changed in accordance with the commodities displayed in the display chamber 11, whereby further effective illumination can be performed.

Furthermore, the LED elements 46 have remarkably long durable years as compared with the fluorescent lamps, which obviates the need for the replacement operation of lightings. Therefore, a laborious operation such as a treatment of waste products discharged owing to the storage and replacement of replacement components does not have to be performed.

In addition, according to the present embodiment, the so-called vertical type open showcase to which the LED illumination device 40 is attached has been described as an example, but the present invention is not limited to this example. Even when the present invention is applied to a horizontal type open showcase, a similar effect can be produced.

What is claimed is:

1. A showcase in which a display chamber constituted in a main body is illuminated by an illumination device, wherein the illumination device is constituted of an LED illumination member including LED elements, and a holding member which is attached to the main body to hold the LED illumination member, and the irradiation angle of light from the LED illumination member is changeable, a pair of holding members corresponding to the opposite ends of the LED illumination member in the longitudinal direction are provided, the LED illumination member including attachment portions which are provided on the opposite ends of the LED illumination member in the longitudinal direction and which are inserted into and held in the holding member, each of the attachment portions having a substantially circular section, a rotation axis substantially similar to a rotation axis of the LED illumination member, and an outer surface provided with a plurality of groove portions on a light irradiation side of the LED elements, and an engaging portion having a protruding curved shape protruding inwards and formed on one of the holding members is selectively engaged with one of the plurality of groove portions formed on one of the attachment portions, whereby the irradiation angle of the light from the LED illumination member is changeable to a new irradiation angle, the engaging portion and engaged one of the plurality of groove portions holding the LED illumination member at the new irradiation angle.

2. The showcase according to claim 1, wherein the LED illumination member is rotated around the axis of the LED illumination member in a longitudinal direction with respect to the holding member, whereby the irradiation angle of the light from the LED illumination member is changeable.

3. The showcase according to any one of claims 1 to 2, wherein the LED illumination member includes a substrate provided with the LED elements, a heat release member, and a reflective plate which is engaged with and attached to the heat release member and which has at least one reflective surface, and the reflective plate presses the substrate onto the heat release member in a state in which the LED elements are opposed to the side of the reflective surface.

4. The showcase according to claim 3, wherein the outer surface of the heat release member has a circular shape around the axis of the LED illumination member in the longitudinal direction.

5. The showcase according to any one of claims 1 to 2, wherein the holding member includes an attachment leg portion which is engageable with an attachment hole in a socket for a fluorescent lamp formed in the main body.

6. A showcase in which a display chamber constituted in a main body is illuminated by an illumination device, wherein the illumination device is constituted of an LED illumination member including LED elements, and a holding member which is attached to the main body to hold the LED illumination member, and the irradiation angle of light from the LED illumination member is changeable, a pair of holding members corresponding to the opposite ends of the LED illumination member in the longitudinal direction are provided, the LED illumination member including attachment portions which are provided on the opposite ends of the LED illumination member in the longitudinal direction and which are inserted into and held in the holding member, each of the attachment portions having a substantially circular section, a rotation axis substantially similar to a rotation axis of the LED illumination member, and an outer surface on a light irradiation side of the LED elements, and an engaging portion having a protruding curved shape protruding outwards and formed on the outer surface of one of the attachment portions is selectively engaged with one of a plurality of groove portions formed on one of the holding members, whereby the irradiation angle of the light from the LED illumination member is changeable to a new irradiation angle, the engaging portion and engaged one of the plurality of groove portions holding the LED illumination member at the new irradiation angle.

* * * * *

UNITED STATES PATENT AND TRADEMARK OFFICE

CERTIFICATE OF CORRECTION

PATENT NO. : 7,824,057 B2
APPLICATION NO. : 12/127284
DATED : November 2, 2010
INVENTOR(S) : Shibusawa et al.

It is certified that error appears in the above-identified patent and that said Letters Patent is hereby corrected as shown below:

In the drawing Sheets:
Delete drawing sheet 6 of 14 and insert sheet 6 of 14, attached Signed and Sealed this
Twenty-sixth Day of April, 2011

David J. Kappos

David J. Kappos
*Director of the United States Patent and Trademark Office*